US005867989A

United States Patent [19]

Platell

[11] Patent Number: 5,867,989

[45] Date of Patent: Feb. 9, 1999

[54] STEAM BUFFER FOR A STEAM ENGINE POWER PLANT

[75] Inventor: Ove Platell, Sigtuna, Sweden

[73] Assignee: Ranotor Utvecklings AB, Sigtuna, Sweden

[21] Appl. No.: 750,833

[22] PCT Filed: Jun. 19, 1995

[86] PCT No.: PCT/SE95/00753

§ 371 Date: Dec. 19, 1996

§ 102(e) Date: Dec. 19, 1996

[87] PCT Pub. No.: WO95/35432

PCT Pub. Date: Dec. 28, 1995

[30] Foreign Application Priority Data

Jun. 20, 1994 [SE] Sweden ..... 9402181

[51] Int. Cl.[6] ..... F01K 1/00

[52] U.S. Cl. ..... 60/659; 165/902; 165/DIG. 539

[58] Field of Search ..... 60/659; 165/902, 165/DIG. 539, 10; 126/617

[56] References Cited

U.S. PATENT DOCUMENTS 4,192,144 3/1980 Pierce ..... 60/659

*Primary Examiner*—Noah P. Kamen

*Attorney, Agent, or Firm*—Jacobson, Price, Holman & Stern, PLLC

[57] ABSTRACT

Disclosed is a steam buffer for use in a steam engine power plant with a closed system and designed to alternately accumulate and emit steam under high pressure and temperature. The steam buffer improves upon conventional steam accumulators which contain water and steam at high pressures and temperature in a large pressurized vessel. The steam buffer functions to store heat in solid material in the walls of a large number of long flow channels with a hydraulic diameter at least as small as 0.5 mm contained in a casing. The flow channels may be formed, for example, by capillary tubes attached to each other or, alternatively, by fine grains of metallic or ceramic material sintered together. The walls of the flow channels perform as the primary heat storing material and are made of a material having a melting point higher than the operating temperature in the steam buffer.

20 Claims, 4 Drawing Sheets

250 bar 500°C 100 bar 450°C

STEAM BUFFER FOR A STEAM ENGINE POWER PLANT

BACKGROUND OF THE INVENTION

1. Field of the Invention

The present invention relates to a steam buffer operating in a steam engine power plant having a closed steam system and is designed to alternately accumulate and emit steam under high pressure and temperature.

2. Description of the Related Art

In a steam engine power plant there is a significant need for a buffer, because at any particular time the amount of steam normally generated and the amount of steam required by the plant do not always correspond to one another. Such storage in a buffer has typically been carried out in a steam accumulator. The steam accumulator consists of a pressure vessel, which is partly filled with water that is heated by a boiler or a steam generator capable of operating at a varying pace. When steam is supplied to the steam engine from the steam accumulator, the pressure tends to decrease. This pressure drop will subsequently cause a spontaneous generation of new steam from the heated water. By using this steam accumulator, large power outputs can be obtained, and the power outputs can be obtained independent of an irregular burning in the steam generator. However, this type of steam-accumulator has several drawbacks because it is heavy and bulky and because the large amount of water and steam at high temperature constitutes a great hazard in the event of fractures in the pressure vessel casing.

In a steam accumulator energy is stored in the pressurized water. There is also the consideration of storing the heat energy in other materials. Thus, it has long been desirable to use an energy storing material which can change between a solid and liquid phase for latent heat. However, when utilizing latent heat there can be problems at phase changes, such as contraction, tensions and chemical exhaustion, which gives rise to mechanical, chemical, heat transfer and functional problems.

SUMMARY OF THE INVENTION

A steam buffer shall accomplish a levelling between power input in the shape of the steam arriving from the steam generator and the power output to the steam engine. This will make it possible to use intermittent and variable energy sources like solar energy in stationary plants and above all will make it possible to obtain considerably higher peak power outputs for short periods than the power which the steam generator is capable of alone. This will also involve the possibility of permitting the burner in the steam generator to operate at a low and constant power even when the steam engine power output is strongly fluctuating.

In a steam engine for vehicular applications with large power output variations, an effective steam buffer makes it possible to design the steam generator at a level for the highest continuous power output required, which is considerably lower than the highest momentary power output that is necessary for only short periods, as for example at acceleration. Further, the steam buffer can also constitute a source of energy storage, which makes it possible to drive the vehicle a certain distance without any exhaust gases, that is no firing of a combustion engine.

An object of the present invention is to provide a steam buffer which is small and light and provides a high power density and energy density, so far not attained. In addition, the buffer provides such a design that it will provide increased safety from accidents when it is used together with steam engines in vehicle applications.

This is obtained by the present invention in that the steam buffer is equipped with a high temperature connection for steam and a low temperature connection for feed water. A large number of elongated flow channels with a hydraulic diameter smaller than about 0.5 mm for the steam and the feed water are between the two connections. These channels are surrounded by pressure resistance walls of a material having a melting point above the highest incident temperature in the buffer and constitutes the primary heat storage substance for the buffer.

In this way, the invention utilizes sensible heat, or temperature changes in solid material. The solid material that constitutes the pressure resistant walls of the flow channels is mainly responsible for the heat storage capacity of the steam buffer.

The invention is particularly distinguished in that the steam buffer consists of a large number, preferably the maximum possible number, of flow channels with a hydraulic diameter at least as small as 0.5 mm. Such small channels require a high pressure to feed steam and water therethrough. A pressure of at least 100 bar is required, which is a pressure that is appropriate for an efficient operating steam engine such as of the displacement type. Despite the high pressure, the expansion strain in the wall material surrounding the flow channels is limited. Since each flow channel itself has pressure resistant walls, there is no need for a pressure resistant vessel capable of being exposed to the high pressure for the whole steam buffer diameter. Thus, there is no danger of an explosion of the vessel and, as is shown below, no danger of outflowing steam exists in the case of damage to the steam buffer.

According to a preferred embodiment of the present invention, the steam buffer is designed, as well as the steam engine, for a pressure above the critical pressure, preferably 250 bar, and a corresponding steam temperature, preferably 500° C., using a hydraulic diameter of 0.2 mm. With these values, it is possible to obtain an energy density of 500 kJ/kg and a power density of 100 kW/kg for the steam buffer, which can be compared with, for example, a lead battery with only 100 kJ/kg and 100 W/kg.

According to a further preferred embodiment of the present invention, the flow channels are formed by using small grains, preferably of a ceramic material, sintered to each other and to the inside of the casing of the steam buffer. The flow channels are thereby formed, between the grains and between the grains and the casing sintered to the grains. The casing can be thin-walled because it is exposed to low expansion strain and mainly has a sealing function, but it also provides a heat storage function like the other material.

BRIEF DESCRIPTION OF THE DRAWINGS

The invention is described in the following in more detail with reference to the attached drawings, which schematically show different preferred embodiments of the steam buffer according to the present invention.

DESCRIPTION OF THE PREFERRED EMBODIMENTS

Figure 1:
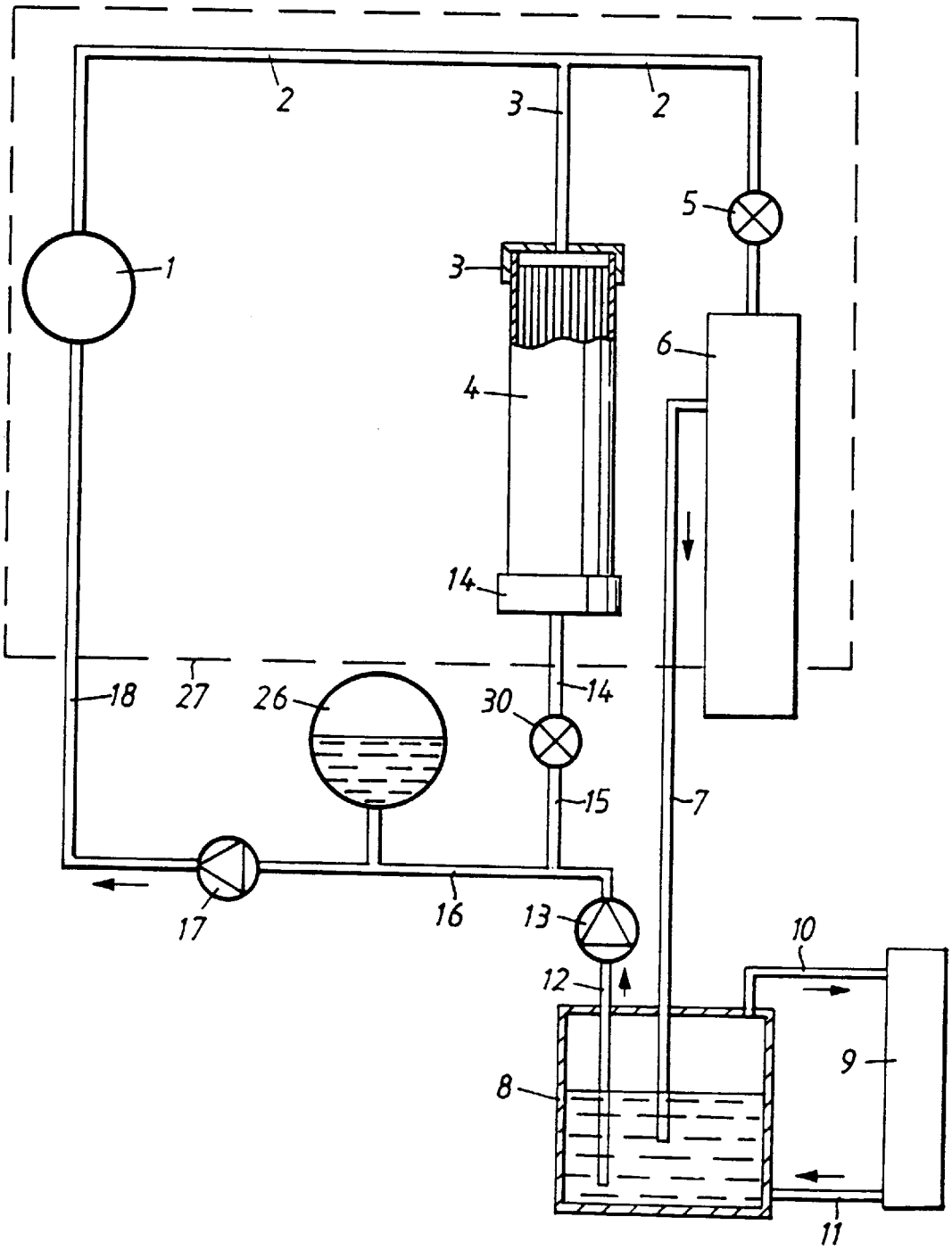
FIG. 1 shows the layout of a steam engine power plant with a steam buffer.
Figure 2:
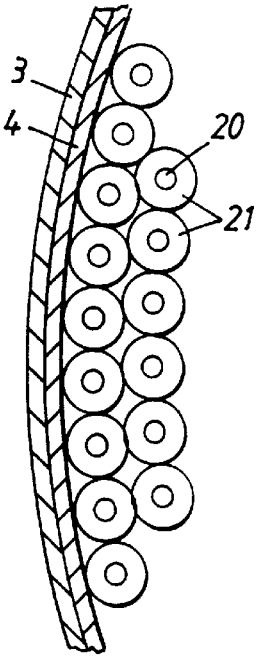
FIGS. 2–5 are partial sections of the steam buffer according to the present invention illustrating preferred forms for the flow channels.
Figure 3:
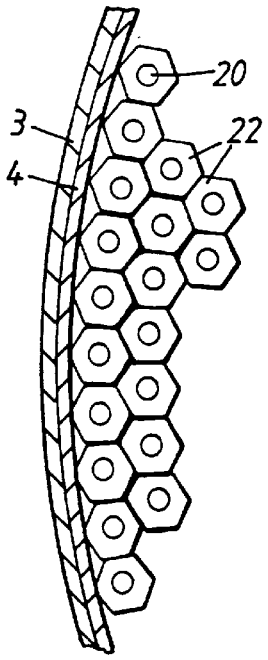
Figure 4:
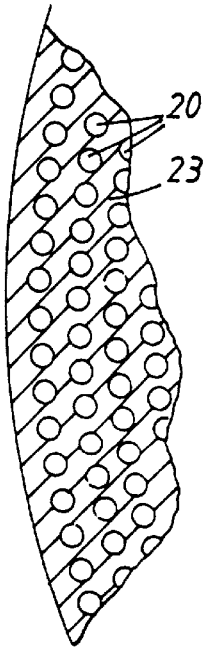

FIG. 1 schematically shows a steam generator 1, which is connected by a steam pipe 2 to a high temperature connection 3 of the steam buffer 4 and to the inlet valve 5 of a multicylinder axial type piston steam engine 6. From the outlet port of the steam engine 6, a pipe 7 leads to a condenser buffer 8, to which a cooler 9 is connected by the pipes 10, 11 for cooling of the feed water and the steam in the condenser buffer 8. From the condenser buffer, a pipe 12 leads to a pump 13 for pumping feed water of high pressure to a low temperature connection 14 consisting of a long heat insulated pipe to the steam buffer 4 via a pipe 15. Pump 13 also feeds a pipe 16 to a circulation pump 17 having an outlet to a pipe 18 that is connected to the steam generator 1.

Figure 5:
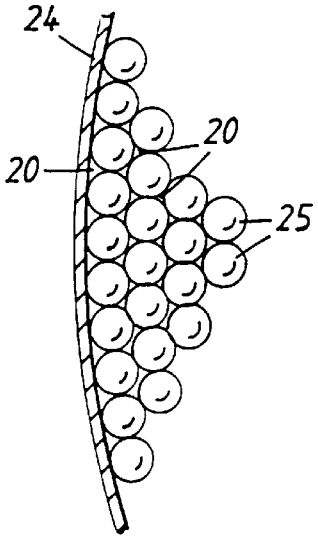

Between the high temperature connection 3 of the steam buffer 4 and the low temperature connection 14 extends a large number of flow channels 20 such as illustrated in FIGS. 2–5. These channels can be formed by a packet of capillary tubes 21 having ends that are extended into the connections 3 and 14 and outer surfaces sealingly adhering to each other and to the connections 3 and 14. The pipes 21 have circular cross sectional areas in FIG. 2, but can alternatively have hexagonal shapes like the pipes 22 in FIG. 3. The flow channels 20 can alternatively be formed by an extrusion of a block 23 of some suitable material in which the flow channels are extended. The pipes 21, 22 and the block 23 can be a metal or ceramic material. An especially preferred design is illustrated in FIG. 5. Within a thin-walled cylindrical casing 24 between the connections 3, 14 are a large number of small grains of ceramic material sintered to each other and to the inside of the casing 24. The flow channels 20 are here formed by the space between the grains 25 and between grains and the inner wall of the casing 24. In all of these embodiments for the buffer flow channels the hydraulic diameter of the flow channels 20 should be at least less than 0.5 mm.

The steam engine power plant generally operates as follows. The steam generator 1 is designed to generate steam in specified discrete power outputs, with a high and a low continuous power output level and preferably some intermediate levels that are chosen depending on the required steam generation. When the valve 5 is closed, the engine 6 is not getting any steam and all generated steam from the steam generator 1 will flow with the pressure of 250 bar and temperature of 500° C. to the steam buffer 4. In the steam buffer, the steam will penetrate the flow channels 20 and force the water inside the flow channels 20 out by the pipe 15 to a buffer vessel 26. Vessel 26 is connected to the pipe 15 and contains a gas cushion against the pressure of which the water is forced into the vessel. The channel material 21, 22, 23, 24 or 25 in the steam buffer 4 is heated from the connection 3 with a transverse temperature front, which moves towards the connection 14. When this temperature front has reached connection 14, the steam buffer is fully charged, and the circulation pump 17 is stopped. The power plant can remain in this fully charged condition for a long time period and is equipped with an effective heat-insulation 27. The insulation 27 houses the steam generator 1, the steam buffer 4 with connection 14, the valve 5 and the top of the steam engine 6 as well as the depending pipes, which together constitute a high temperature part. The rest of the plant constitutes a low temperature part with a temperature of approximately 80° C. Some heat losses will of course be unavoidable, but can be made so small that the losses can be compensated by starting the steam generator 1 and allowing it to run for only a couple of minutes after a several day interval period to restore the intended temperature level.

When the valve 5 is opened for driving the steam engine 6 at normal low load, the continuously generated steam from the steam generator will be enough. When the valve 5 is opened for driving of the steam engine 6 at high load for short time periods, for example during acceleration when passing another vehicle, the main steam will be supplied from the steam buffer 4. The steam buffer will preferably give in the order of ten times more steam than the steam generator 1 alone can supply. The steam leaves by connection 3, and the feed water from the buffer 26 is forced by the gas cushion into the steam buffer 4 through the connection 14. In the steam buffer 4, the water is vaporized by the surrounding hot material, and the temperature front moves slowly in the direction toward the connection 3. When this temperature front reaches the connection 3, the steam buffer is fully unloaded and only the steam from the steam generator 1 is available for use by steam engine 6.

Figure 6A:
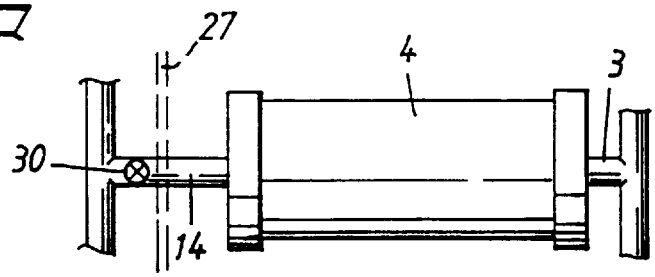
FIG. 6*a* is a schematic side view of the steam buffer.
Figure 6B:
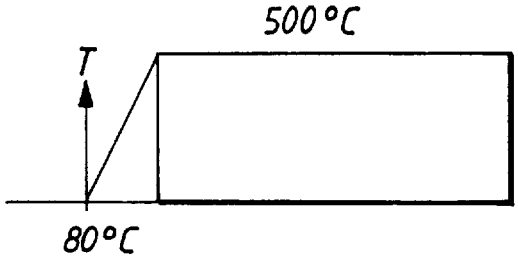
FIGS. 6*b–f* show temperature profiles of the material in the steam buffer at different conditions of charging.
Figure 6C:
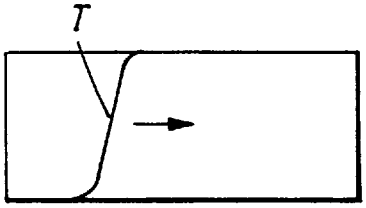
Figure 6D:
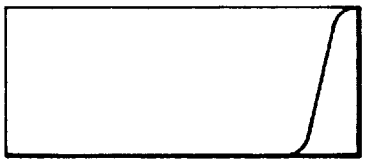
Figure 6E:
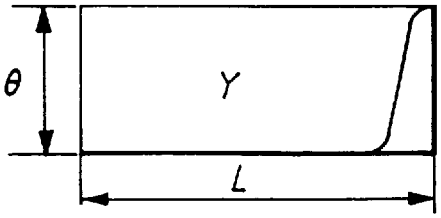

The above described process of charging the buffer 4 is illustrated in FIGS. 6*a*–6*f*. FIG. 6*a* shows the steam buffer 4 with the low temperature connection 14 and the high temperature connection 3. At fully charged condition the temperature in the steam buffer from one end to the other end is as the curve illustrates in FIG. 6*b*, that is approximately 80° C. outside the heat insulation and 500° C. along the whole steam buffer length. After a long time in the fully charged condition, the temperature distribution along the long pipe in connection 14 is as FIG. 6*b* illustrates. The temperature gradient in connection 14 is responsible for the largest amount of heat leakage from the steam buffer 4, but this leakage can be made small if the pipe 14 is made long. During the discharge, the steam flows out via connection 3, and the water flows in via connection 14. The transverse temperature front T is then formed as according to FIG. 6*c*. The temperature front will move slowly towards the connection 3 with a velocity of propagation that is always lower than the velocity of the fluid of steam and water. The speed is related to the velocity of the flowing fluid and the heat capacity of the fluid and the heat exchanger material. The discharge will take place with an unchanged temperature and almost unchanged pressure of the discharged steam until the front T reaches the connection 3, as shown in FIG. 6*d*.

If the heat transfer conditions are favorable and the flow velocity is not too high, which is a function of the number of flow channels, there will be a very steep rise at the temperature front, which is important in order to obtain high energy density. The high energy density is defined as the real power output possible to be obtained compared to the material weight of the steam buffer. The real energy discharged is in turn the energy discharge that can be made with a guaranteed quality of steam from a fully charged steam buffer until the required steam quality is no longer available at the outlet 3. This latter condition is illustrated in FIG. 6*d*. During the whole discharge time up until the condition in FIG. 6*d*, the discharged steam has the same quality as the steam that charged the steam buffer. When the position in FIG. 6*d* is reached, feed water that has been flowing in at 14 has been heated to a nominal steam temperature by the heat transferred from all the material which transfers its energy content from 500° C. to 80° C. This occurs for all of the material through which the temperature front has passed, and the energy will correspond to the marked section Y in FIG. 6*e*. The ratio between Y and the entire section in FIG. 6*b* is defined as the ratio of utilization, which for the steam buffer according to the present invention can be between 85–95%. With high steam temperatures of 800°–900° C. that can be used if the whole steam system is designed in ceramics, it is possible to obtain an energy density of about 1 MJ/kg.

Figure 6F:
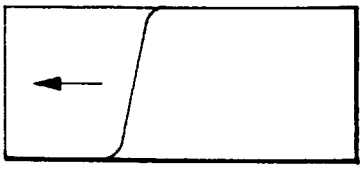

At repeated charging, the temperature front moves in the opposite direction, as is shown in FIG. 6*f*, until a new discharge takes place or the steam buffer becomes again fully charged, as in FIG. 6*b*.

A condition for obtaining a high energy density is a rise of the temperature front in the steam buffer that is as steep as possible, and it can be shown that a hydraulic diameter of the channels should be some tenths of a millimeter. It can also be shown that a high power density, defined as the power per kg which can be withdrawn without large unacceptable pressure losses, requires a high steam pressure, a high value on the ratio between the total area of the cross section of the flow channels and the total cross sectional area of the wall buffer material and the flow channels, a high steam temperature, a low density of the buffer material, which makes ceramic material favorable, and a small hydraulic diameter as with for a high energy density.

Figure 7A:
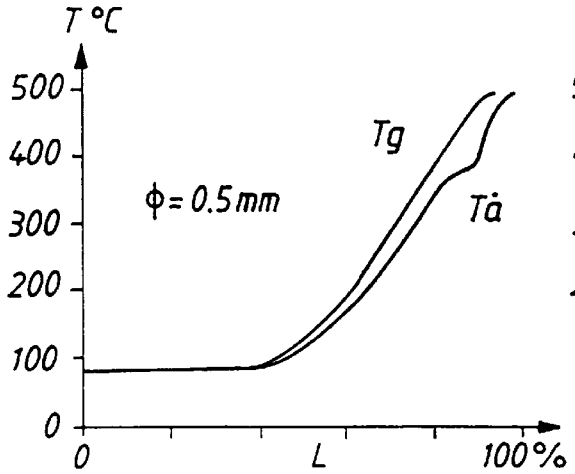
FIGS. 7*a–d* illustrate temperature profiles for both the channel material and the steam at the end of the discharge process from the steam buffer at different pressure values and different diameters for the flow channels.
Figure 7B:
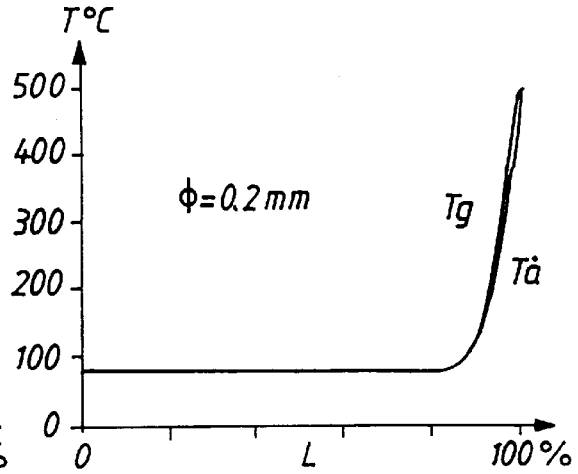
Figure 7C:
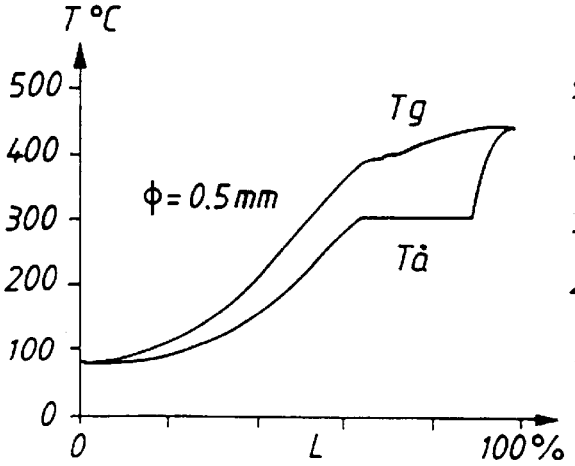
Figure 7D:
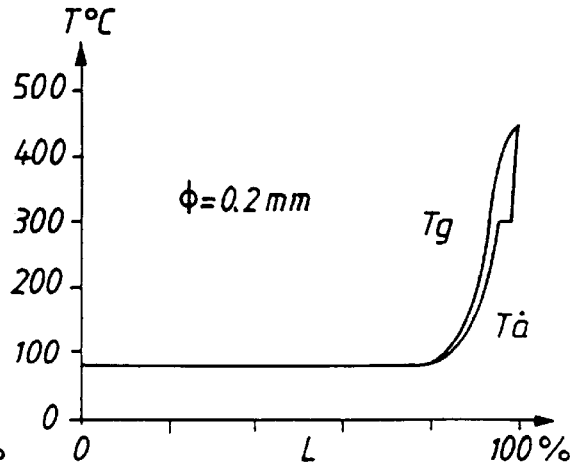

The hydraulic diameter and its influence on the steepness of the temperature front is illustrated in FIGS. 7*a*–7*d* at different operational modes. FIGS. 7*a* and *b* show the temperature of the steam buffer along its relative length at pressure 250 bar and steam temperature 500° C. for flow channels with a hydraulic diameter of 0.5 and 0.2 mm, respectively. Tg and Ta refer to the temperature curves for the wall material and the steam, respectively. FIGS. 7*c* and *d* show corresponding curves at a pressure of 100 bar and a steam temperature of 450° C. In both cases, it is illustrated that for a change from 0.5 to 0.2 mm for the hydraulic diameter the temperature steepness will increase dramatically, especially in the case with the higher pressure and temperature values.

Despite the high pressure and temperature of the steam engine power plant, there is a very low risk of damage to the surroundings from an explosion and/or outflowing of hot steam, especially from the steam buffer, because the steam buffer is not contained in a large pressure resistant vessel and because the flow channels will contain only a minor amount of hot steam/water. The steam will be generated at the same pace at discharge as the feed water flows into the flow channels and will only take place if the steam buffer is intact. It can also be equipped with a pipe break valve 30 in the pressurized pipe 15 which is leading the feed water to the steam buffer 4. A greater velocity of the feed water than a predetermined value, for example fully open valve 5 or full load, will rapidly close the valve 30, and the steam generation in the buffer 4 will stop.

The invention is of course not restricted to the above described steam buffer designs and steam data but can be modified in several ways within the scope of the present inventive idea defined by the claims.

I claim:

1. A steam buffer for utilization in a steam engine plant with a closed steam system designed to alternately accumulate and emit steam under high pressure and temperature, comprising a high temperature connection for steam, a low temperature connection for feed water, a plurality of elongated flow channels having a hydraulic diameter no more than 0.5 mm through which flows the steam and the feed water between said high temperature connection and said low temperature connection, said flow channels being surrounded by pressure resistant walls, said walls being made of a material that has a melting point above the highest occurring temperature in the steam buffer and being a primary heat storage substance for the steam buffer.

2. A steam buffer according to claim 1, wherein the steam buffer operates at a pressure higher than a critical pressure of 100 bar, and a steam temperature of 500° C., and said flow channels having a hydraulic diameter of 0.2 mm.

3. A steam buffer as described in claim 2, wherein said steam buffer operates at a pressure up to 250 bar.

4. A steam buffer according to claim 1, wherein said flow channels are formed by parallel capillary pipes which are attached to each other.

5. A steam buffer as described in claim 4, wherein said capillary pipes are attached by hard solder.

6. A steam buffer as described in claim 4, wherein said capillary pipes are attached by being sintered together.

7. A steam buffer according to claim 1, wherein said flow channels are formed in an extruded block.

8. A steam buffer according to claim 1, wherein said flow channels are formed by sintering fine grains made of metallic material to each other inside of a casing and said grains are also sintered to the inside of said casing.

9. A steam buffer as described in claim 8, wherein said fine grains are made of a ceramic material.

10. A steam buffer according to claim 1, wherein said flow channels and said pressure resistant walls have an energy density of up to 500 kJ/kg and a power density of between 10–100 kW/kg.

11. A steam buffer according to claim 1, wherein a pressurized pipe for feed water connected to said low temperature connection includes a valve arranged to close when flow velocity in the pressurized pipe exceeds a predetermined value.

12. A steam buffer according to claim 1, wherein said low temperature connection includes an elongated heat insulated pipe.

13. A steam buffer for use in a steam engine power plant to store and release steam energy, comprising a low temperature connection to feed water, a high temperature connection for steam, a plurality of flow channels formed in pressure resistant walls extending between said low and high temperature connections, and said flow channels having a diameter of at less than 0.5 mm.

14. A steam buffer as described in claim 13, wherein said pressure resistant walls are made of a material having a melting point higher than an operating temperature in the steam buffer.

15. A steam buffer as described in claim 13, wherein said pressure resistant walls absorb energy from steam for storage and emit the energy to form steam.

16. A steam buffer for a steam engine system to store generated steam energy and release energy to produce steam to the steam engine, comprising a high temperature connection for steam, a low temperature connection for water, a number of flow channels extending from said high temperature connection to said low temperature connection, said flow channels formed in a pressure resistant material having a melting point higher than an operating temperature of the steam buffer, and said flow channels having a very small diameter.

17. A steam buffer as described in claim 16, wherein said flow channels have a diameter less than or equal to 0.5 mm.

18. A steam buffer as described in claim 16, wherein said flow channels are formed in pressure resistant walls that absorb and emit steam energy.

19. A steam buffer as described in claim 16, wherein said flow channels are formed between fine grains sintered together within and to a casing.

20. A steam buffer as described in claim 16, wherein said flow channels are formed by extended tubing attached to one another.

* * * * *